US007478639B2

(12) United States Patent
Stachowski

(10) Patent No.: US 7,478,639 B2
(45) **Date of Patent: *Jan. 20, 2009**

(54) SYSTEM FOR STYLING HAIR

(76) Inventor: Barbara Stachowski, 11 El Gavilan, Orinda, CA (US) 94563

( * ) Notice: Subject to any disclaimer, the term of this patent is extended or adjusted under 35 U.S.C. 154(b) by 0 days.

This patent is subject to a terminal disclaimer.

(21) Appl. No.: 09/742,871

(22) Filed: Dec. 20, 2000

(65) Prior Publication Data

US 2007/0095361 A1 May 3, 2007

Related U.S. Application Data

(63) Continuation-in-part of application No. 09/549,764, filed on Apr. 14, 2000, now Pat. No. 6,286,519.

(51) Int. Cl.
*A45D 24/00* (2006.01)
*A45D 8/00* (2006.01)

(52) U.S. Cl. ..... 132/200; 132/273

(58) Field of Classification Search ..... 132/273–279, 132/150, 148, 144, 133, 212, 124, 120, 200, 132/219; D28/9, 10

See application file for complete search history.

(56) References Cited

U.S. PATENT DOCUMENTS 3,696,823 A * 10/1972 Dannat ..... 132/122
3,928,871 A 12/1975 Wall ..... 2/161 R (Continued)

FOREIGN PATENT DOCUMENTS

DE 299 16 450 2/2000

(Continued)

*Primary Examiner*—Robyn Doan
(74) *Attorney, Agent, or Firm*—Haverstock & Owens LLP

(57) ABSTRACT

This invention is a system and a method for styling hair and parting hair according to a predetermined pattern. The invention utilizes a stencil that has a patterned edge. Preferably, the stencil is a flattened elongated stencil device that is formed from a resilient material, such as plastic polyurethane or rubber, and is capable of conforming to the curvature of a human head. In operation the stencil device is placed over the area of hair to be styled and the patterned edge of the stencil device is traced through the hair with a parting device. The hair is then separated along the trace with the parting device to created a hair style with a part patterned substantially similar the patterned edge of the stencil device used. The parting device preferably has a tip portion for tracing the part through the hair and a handle portion for separating the hair. Preferably, the handle portion of the parting device has two movable handles that are hingably attached to the tip portion and which open and close in a "jaw-like" fashion. Accordingly, the tip portion is moved through the hair near the scalp while tracing along the patterned edge of the stencil device. The handles are preferably in the closed position and with the tip portion pointing in a forward tracing direction. While tracing the tip through the hair, the hair flows over the handles and collects on the handles. After the tracing is complete, the hair is separated by lifting the parting device through the hair with the handles in the open position. Alternatively, the parting device has a tip portion and a flared body portion. Accordingly, the hair is separated as a result of the hair flowing from the tip portion over the flared handle as the tip section is traced through the hair.

2 Claims, 13 Drawing Sheets

U.S. PATENT DOCUMENTS 4,483,354 A * 11/1984 Marcotte ..... 132/213
5,107,869 A * 4/1992 Henry ..... 132/213.1
5,231,999 A * 8/1993 Schroettner ..... 132/137
5,348,030 A * 9/1994 Hirzel ..... 132/123
5,494,057 A * 2/1996 Gianfrancesco ..... 132/214
5,704,376 A 1/1998 Ogunro ..... 132/213.1
5,921,252 A * 7/1999 Chubb ..... 132/144
6,062,231 A * 5/2000 De Laforcade ..... 132/145
6,082,307 A * 7/2000 Landreneau ..... 119/616

FOREIGN PATENT DOCUMENTS

EP 09154625 6/1997

* cited by examiner

SYSTEM FOR STYLING HAIR

RELATED APPLICATIONS

This patent application is a continuation-in-part of the U.S. patent application Ser. No. 09/549,764, filed Apr. 14, 2000, now U.S. Pat. No. 6,286,519 and entitled "Device for Hair Styling Hair". The application Ser. No. 09/549,764, filed Apr. 14, 2000, and entitled "Device for Hair Styling Hair" is hereby incorporated by reference.

FIELD OF THE INVENTION

The invention relates to hair styling systems and methods. More specifically, this invention relates to a hair styling systems and methods for creating hair styles with complex geometric parts.

BACKGROUND OF THE INVENTION

Hair styling often involves manipulating hair into a preferred orientation or style and securing the hair in that preferred orientation or style. This current invention is a device for manipulating hair into a preferred orientation or style by parting or separating sections of hair. Hair is usually parted or separated with a comb or a brush. It can be difficult to obtain a straight part or a consistent part with theses well known devices. It is even more difficult to create a complex part in hair such as a curved or a zig-zag part. In order for make a zig-zag part, for example, with a comb or a brush, each section of hair must be carefully combed or brushed and then separated. The current invention provides a device and method for creating complex parts in a hair style quickly and easily.

SUMMARY OF THE INVENTION

The system and method of the instant invention allow a user to create hair styles with complex parts. Preferably, the system and method of the instant invention utilize a stencil with a patterned edge also referred to, herein, as a styling edge. The styling edge of the stencil is used as a guide for the user to trace the pattern of the styling edge through an area of hair and to create a part in the hair with a pattern that is substantially similar to the styling edge of the stencil. The pattern is traced though the hair with any suitable parting device that can closely follow or trace the pattern on the styling edge of the stencil through the hair and then separated the hair according to the pattern.

The styling stencil is preferably a flattened elongated stencil with an average length between 5 and 30 cm, an average width between of 2 to 10 cm and an average thickness between 0.1 and 1 cm. The styling stencil is formed from a resilient material such as plastic, polyurethane or rubber and is capable of conforming to the curvature of a human head. The system and method of the instant invention utilizes one styling stencil or a plurality of styling stencil to create hair styles with complex parts.

The styling edge of the stencil is patterned or contoured with any number of geometric shapes but is preferably contoured with repeating geometric shapes such rounded scallops, squared teeth or pointed teeth. The styling edge of the stencil is preferably an outer edge of the stencil. Alternatively, the styling edge is any edge of a stencil that is traceable with a parting device and suitably configured to create hair styles with parts.

In operation the stencil device is paced over an area of hair to be parted. The stencils is held against the head of the user or the head of the person whose hair is being styled. The pattern of the styling edge is traced through the hair with the parting device. The pattern is preferably traced through the hair near the scalp of the user to obtain a high resolution part. Most preferably, the pattern is traced through the hair with a pointed or tip-shaped parting device that is moved through the hair with the tip portion of the device pointing in a forward tracing direction. Either while the pattern is being traced or after the tracing is complete, the hair is separated along the trace to create a hair style with a part that has a pattern substantially similar to the patterned edge of the stencil device. Preferably, the parting device is used to trace the pattern through the hair and to separate the hair as described in detail below.

Preferably, the parting device has a tip portion for tracing the part through the hair and a handle or body portion for separating the hair. The parting device is preferably flared from the tip portion to the handle portion. As the tip portion moved through the hair, with the tip pointed in a forward tracing direction, the hair flows over the handle or body portion and is partially separated. After the tracing is complete, the hair is completely separated by lifting the parting device through the hair.

In a preferred embodiment of the invention the parting device has movable handles that open and close to further facilitate the separating of the hair about the part after the pattern is traced through the hair. Accordingly, two handles are hingably attached to the tip portion and the handles open and close in a "jaw-like" fashion. The tip portion of the parting device is moved through the hair near the scalp, as described above, with the handles in a closed position. After the pattern is traced through the hair, the hair is further separated by lifting the parting device through the hair and placing the handles in the open position.

According to further embodiments of the invention the parting device has a solid extended tip section and two elongated handles. The elongated handles are attached by one of their ends to the tip section such that the handles are capable of being opened and closed in a "jaw-like" fashion about the solid tip section. The handles are preferably flattened and substantially planar with enlarged or flared grasping ends. Preferably, the solid tip section is also flattened and is coplanar with the handles. In an alternative embodiment, the tip section is angled. The angle of the tip, relative to the handles or the plane formed by the handles, is preferably less than 45 degrees.

Each of the two handles of the parting device are attached to the tip portion through a hinge element which allow the handles to be opened and closed. The hinge elements are any hinge elements known in the art, such as hinge pins, which interlock rotatable parts. The hinge elements may also include tension coil springs that urge the handles to return to the open or the closed position in the absence of an applied force. Alternatively, the hinge elements are leaf spring made of a resilient deformable material, wherein the handles are placed in the opened or closed position by deforming the leaf spring.

The parting device is either a monolithic device or is formed in parts. Preferably the parting device is formed from a resilient material such as plastic, rubber or polyurethane. However, it will be clear to one skilled in the art that the device or portions thereof can also be made from other materials including metal and any combination of the aforementioned materials.

According to one embodiment of the invention the hinge elements are leaf springs are provided by a modified structure at the hinging points in the monolithic device. For example, by having reduce d thicknesses of the resilient material at the hinging points, the handles will bend through these points when a deforming force is applied to the handles. Further, the handles will return their original resting position in the absence of the applied force.

In another embodiment of the invention the system of the invention includes a grooming element such as a comb or a brush section that is detachably fixed to the parting device. In this way the parting device can serve as the handle for the attached comb or brush which can then be removed when using the parting device to part hair.

In other embodiments, the complete parting device or a portion of the parting device functions as a hair pin. For example, in one embodiment of the invention, at least one handle is detachable from the tip portion of the parting device. The detached handle of the parting device is then free to be used as a hair pin.

In still another embodiment of the invention the parting device has a locking mechanism to secure the device in a closed position. The locking mechanism preferably secures the handles in the closed position near the unattached or free ends of the handles. The locking mechanism is preferably a hook that hinges on one of the handles and is capable of wrapping around a portion or a receiving a section of the other handle when the handles are in the closed position. Further, providing the adjacent interior surfaces of the handles with small teeth allows the parting device to secure a section of hair between the handles while the handles are in the closed position and are secured, thus providing for a parting device that is also capable of being used as a hair clip.

In still another embodiment of the invention the parting device has a spring element that is in contact with both handles for urging the handles to the open position. In this embodiment of the invention, the parting device is capable of being held in the closed position with one hand and is allowed to open without using the another hand. This embodiment allows a hair stylist to create a complex hair parts with one hand while leaving the other hand free to perform other tasks such as securing or holding the styling stencil in place.

In alterative embodiments, the parting device has two handle sections that are connected together by a single hinge element or no hinge. In these embodiment the ends of the handles form the tip section of the parting device. Whether the parting device used in the system and method of the instant invention has no hinge, a single hinge or two hinges, a part in the hair is created by providing a stencil with a predetermined pattern along the styling edge of the stencil. The stencil is placed on the section of hair to be styled. With the tip section of the parting pointed forward, the tip section is guided or traced through a section of hair near the scalp and along a styling edge of a stencil, such that hair flows over the parting device. Separating the hair either during the trace or after the trace results in hair part with a geometric shape that is substantially similar to the styling edge of the stencil.

Figure 1:
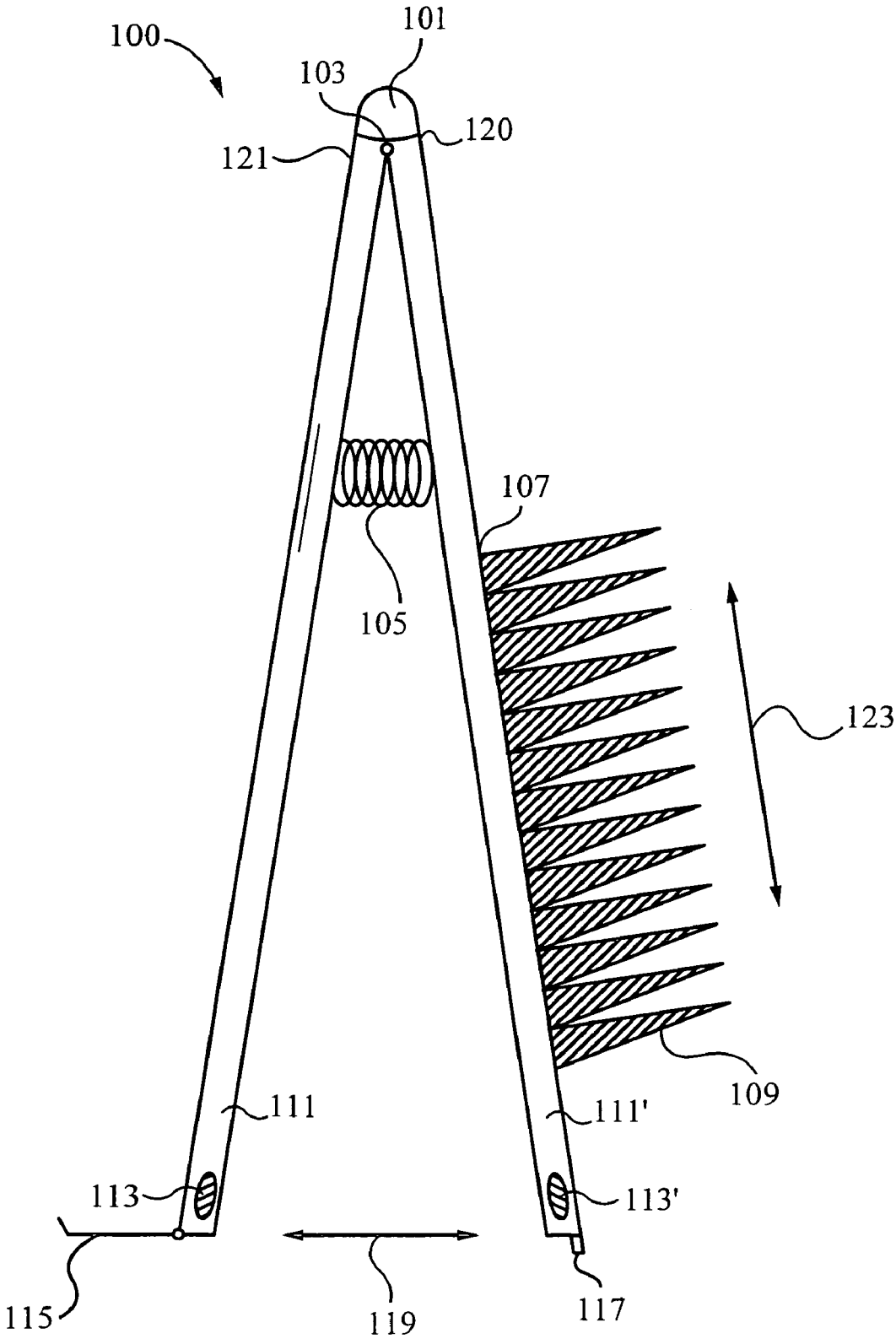
FIG. 1 shows a parting device according to the current invention with detachable comb section.

DETAILED DESCRIPTION OF THE INVENTION:

FIG. 1 illustrates a parting device 100 according with an embodiment of the current invention. The device 100 has two elongated handles 111 and 111' that are connected together at one end of each handle 120 and 121 through a hinge element 103. The ends 120 and 121 form a tip section 101 that is used to guide the parting device through hair to form a part in the hair. The device 100 is capable of being placed in an open position (as shown) and place in a closed position (not shown) by separating the handles 111 and 111' and bring the handles together in a "jaw-like" fashion as indicated by the arrow 119. The tip section 101 preferably does not open or close or become in anyway separated while moving the handles 111 and 111' as described. This is accomplished in any number of ways. One way to accomplish this goal is by attaching the handles 111 and 111' through a hinge element at the very ends 120 and 121 of the handles 111 and 111' such that the hinge and the tip section of the device are the same (not shown). Alternatively, the attached ends 120 and 121 of the handles 111 and 111' are flattened, curved and overlapping such that a gap does not form at the tip section 101 during the opening and closing of the handles 111 and 111'.

Again referring to FIG. 1, the handles are equipped with finger pads 113 and 113' for grasping and positioning the parting device 100 in the opened and closed positions. According to a further embodiments of the invention, the parting device 100 has a spring element 105 position between the handles 111 and 111' for urging the handles 111 and 111' to separate to the open position. In yet another embodiment of the invention the device 100 has a locking element for securing the device 100 in the closed position. A latch 115 is attached to the handle 111. A receiving post 117 is attached to the other handle 111'. The device 100 is placed in the closed position and the latch 115 is folded over and onto the receiving post 117 and thus securing the device in the closed position. While a two part locking element is preferred, a simple hook attached to one handle that is capable of looping around the other handle in order to secure and lock the handles in the closed position is considered to be within the scope of the invention.

In an alternative embodiment of the invention, a grooming element 109 such as a comb or a brush section is attached to a portion 107 of the parting device handle 111'. Preferably the grooming element 109 is detachable fixed to the portion 107 of the handle 111' and can be removed when using the parting device 100 to create parts in hair. The grooming element 109 is detachably fixed to a portion of the handle 107 by any suitable means including two piece interlocking snaps or hook and loop fabric interlocks. Alternatively, the grooming element 109 may be slidably positioned into to a grove on the side of the handle 107 such that sliding the grooming element 109 in one direction or the other direction along the length of the handle 111', as indicated by the arrow 123, allows the element to be released from the handle 111'.

Figure 2A:
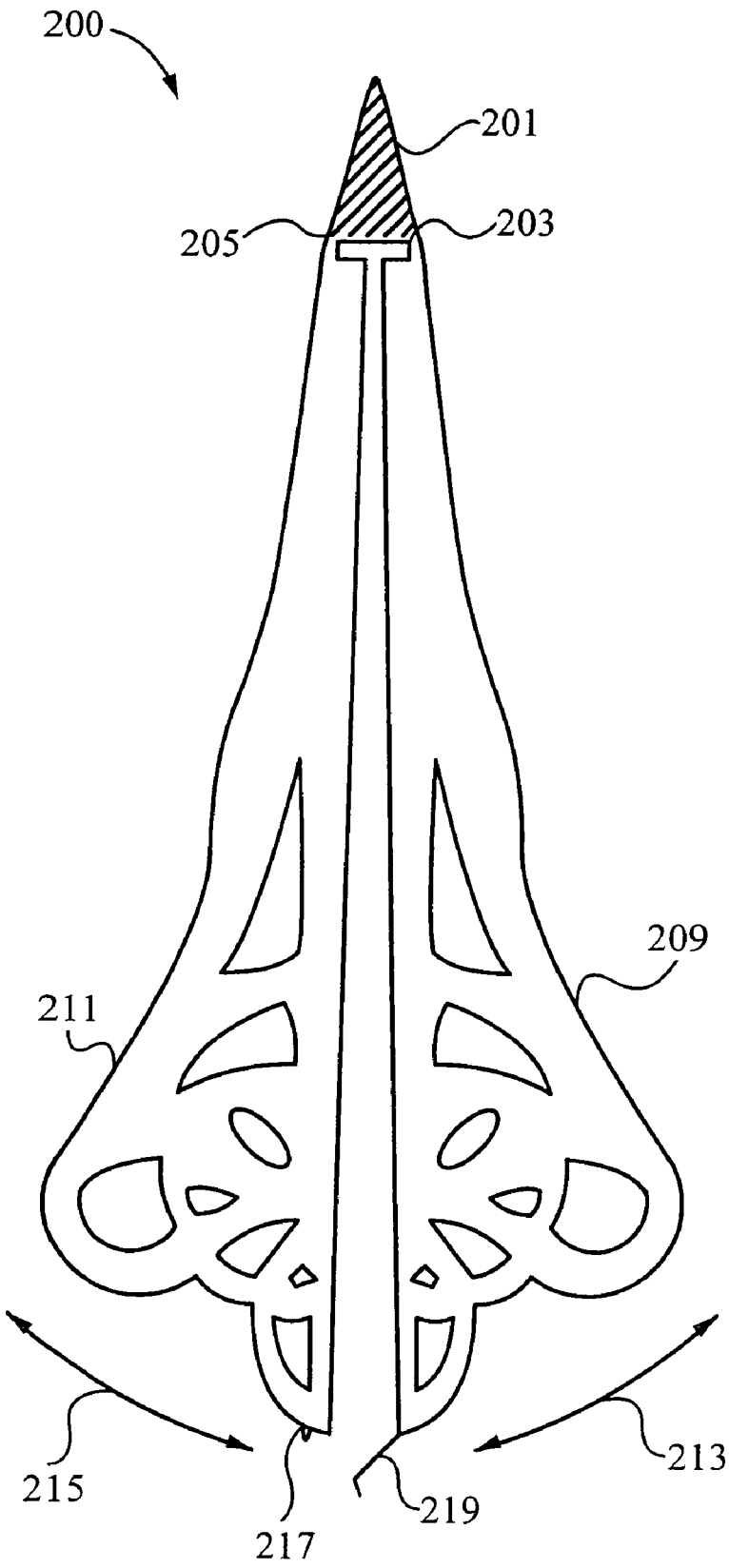
FIG. 2*a* shows a parting device with leaf spring hinges in accordance with present invention.

In preferred embodiments of the invention the hair styling parting device 200 has two handles that are independently attached to a tip section, as shown in FIG. 2*a*. Preferably, the handles 211 and 209 are flared at grasping ends and are reticulated as shown for providing both beauty and function to the parting device 200. The tip section 201 is used to guide the parting device 200 through hair during a styling operation. The handles 209 and 211 move in the directions 213 and 215 through the hinge elements 203 and 205, respectfully. By moving the handles 209 and 211 towards each other the parting device will assume a closed position, as shown, and by separating the handles apart from each other the parting device 200 is placed an open position. Upon releasing the handles 209 and 211 the parting device 200 will preferably return to the closed position.

Hinge elements used in the parting device of the current invention are any hinge elements that are known in the art including hinge pins, hinge pins that are couple with tension coil springs or hinge screws. Hinge pins coupled with tension coil springs are used to urge the handles to assume a closed or open position in the absence of an applied force.

In an embodiment of the current invention, the invention the parting device 200 is monolithic, wherein the tip section 201, the hinge elements 203/205 and the handles 209/211 are formed from a single resilient pliable material such as plastic, rubber or polyurethane. Accordingly, the hinge elements 203 and 205 are thin pieces of the resilient pliable material connecting the thicker tip section 201 and the t handles 209/211 such that the hinge elements 203 and 205 flex or bend when handles 209 and 211 are pulled apart or drawn together.

While the parting device 200 is shown as a monolithic parting device, it will be clear to one skilled in the art that the parting device 200 may be made of several parts and using any number of different materials. For example, in an alternative embodiment the handles 209/211 and tip section 201 are plastic connected together through metal leaf spring hinge elements. The device 200 is configured with a latch mechanism 217 and 219 securing the device 200 in the closed position during storage.

Figure 2B:
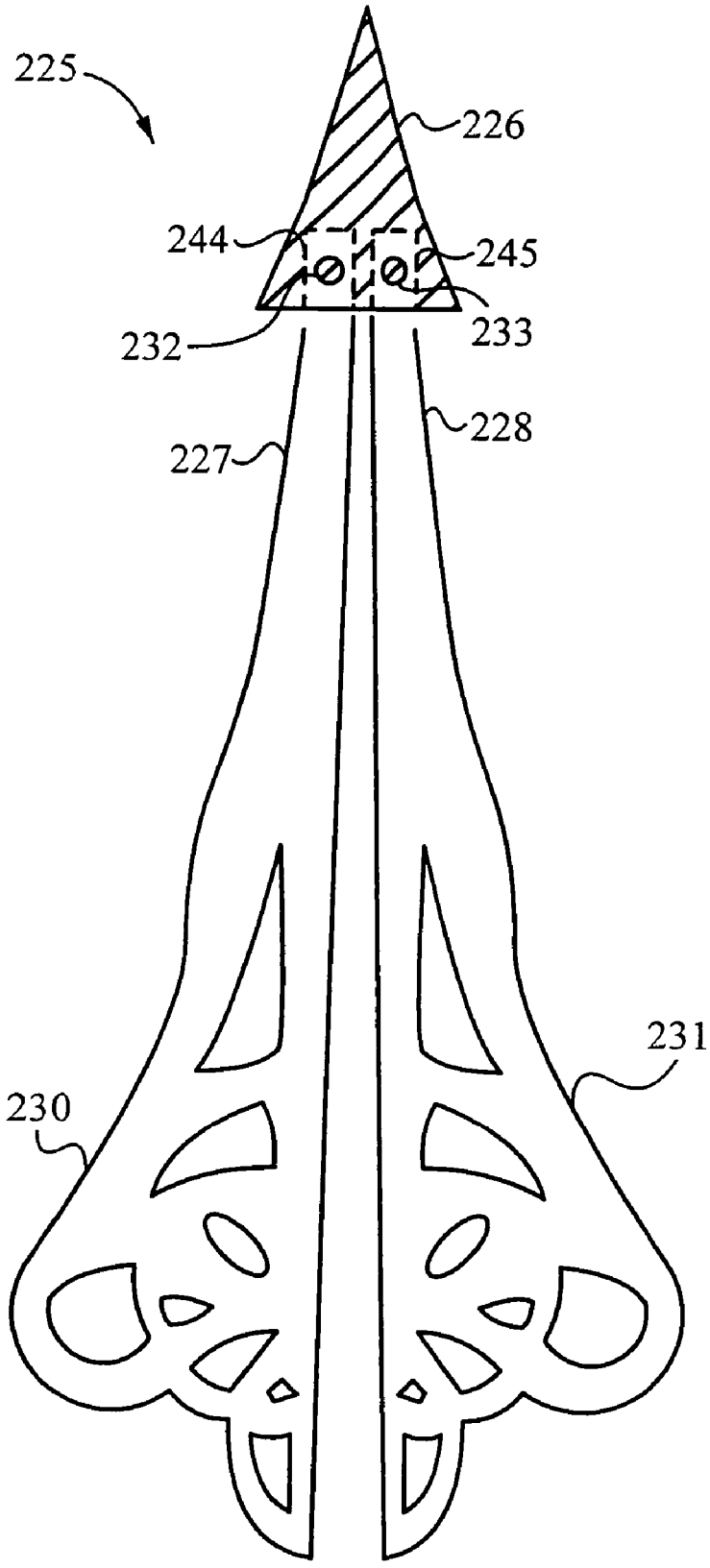
FIG. 2*b* shows a parting device in accordance with a preferred embodiment of the present invention.

Now referring to FIG. 2*b*, the parting device 225 has a plastic tip section 226 with hollow inserts, shown by the dotted lines 244/245, for inserting and attaching ends 227/228 of the handle sections 230/231, respectively. The handle sections 230/231 are then held fixed to the tip section 226 with hinge screws 232/233. The handles are capable of opening and closing in a jaw like fashion through the screw hinges 232/233 as described previously. Alternatively, the attaching ends 227/228 of the handle sections 230/231 are configured to fit over a portion of the tip section 226 section or are adapted to attach to the tip section 226 such that the handles 230/231 open and close.

Figure 3:
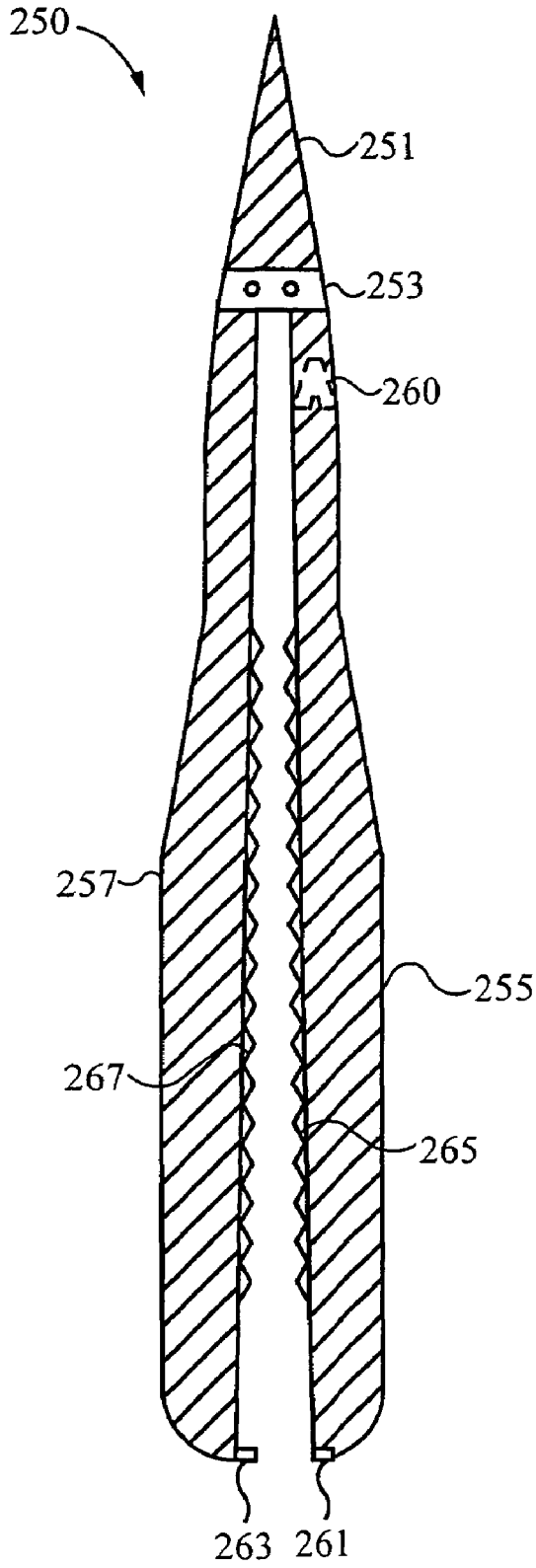
FIG. 3 shows a parting device that is also capable of being used as a hair clip and a hair pin, in accordance with the present invention.

FIG. 3 shows a parting device 250 incorporating several alternative embodiments according to the present invention. The parting device 250 has two handles 255 and 257 that are hingably attached by a hinge section 253 to a tip section 251, wherein the handles 255 and 257 open and close in a "jaw-like" fashion as described previously. The parting device 250 also has a two part pressure snap mechanism comprising a female portion 261 and male portion 263 that snap together and secure that parting device 250 in a closed position. The handle 255 is capable of being detached at the insert joint 260 from the rest of the parting device and is capable of being used as a hair pin. Further, adjacent interior portions 265/267 of the handles 255/257 have teeth for holding hair between the handle with the parting device 250 secured in the closed position. Thus the parting device 250 may also be used as a hair clip when it is not being used to style hair.

Figure 4A:
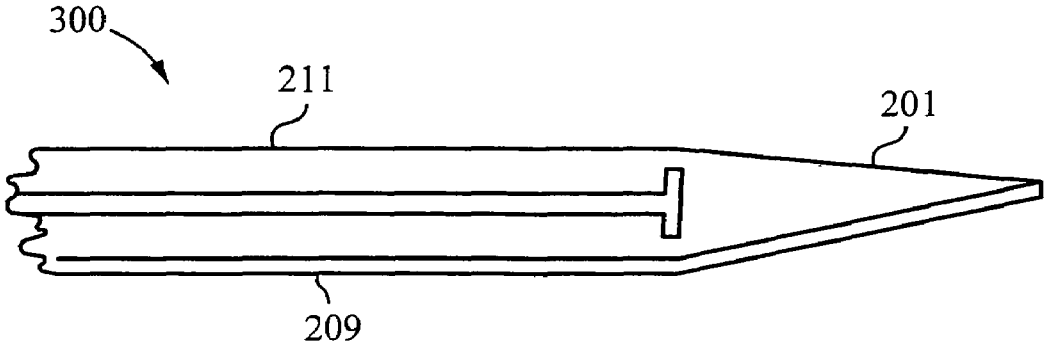
FIG. 4*a-b* illustrate straight and bent tip sections of a parting device.
Figure 4B:
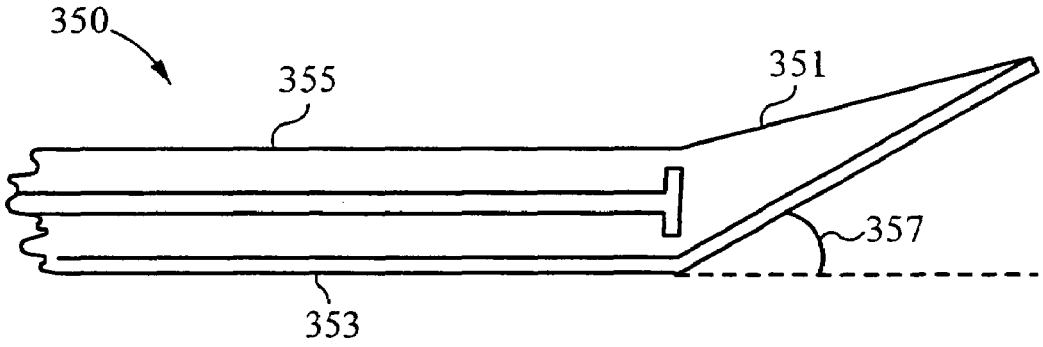

FIG. 4*a* shows a perspective view 300 of a portion of the parting device 200 shown in FIG. 2. The tip section 201 is flattened and coplanar with the handles 209 and 211. FIG. 4*b* shows a perspective view 350 a portion of the parting device according to an alterative embodiment. The tip section 351 is angled out of the plane formed by the handles 353 and 355. An angled tip configuration, such as illustrated in FIG. 4*b*, helps to ensure that the tip section 351 is guided through the hair and near the scalp while creating a hair style. Tip sections, in accordance wit the instant invention, are configured to have any angle 357 relative to the plane formed by the attached handles 353 and 355 that is less than 45 degrees. The tip section is configured to be rigid or alternatively is configured to be movable and assume a range of angles 357 during use.

Figure 5A:
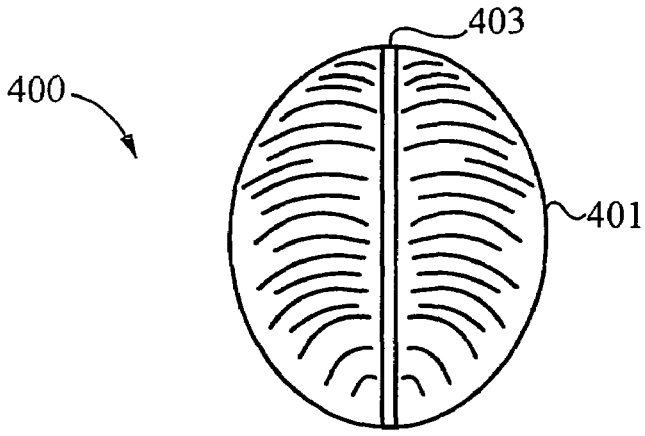
FIG. 5*a-c* illustrate top views of parts in hair.
Figure 5B:
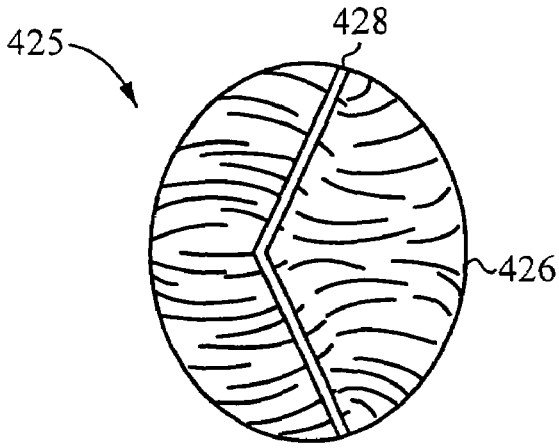
Figure 5C:
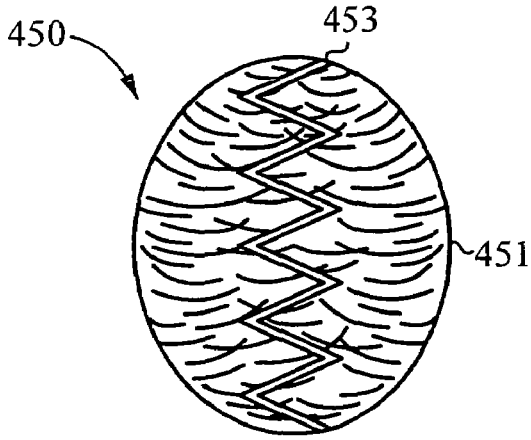

The parting devices illustrated in the FIGS. 1-4 are used to create any number of hair styles with parts. For illustrative purposes, a few hair styles that are capable of being created with the parting devices described in FIGS. 1-4 are shown in FIGS. 5*a*-*c*. FIG. 5*a* shows a top view 400 of a the head 401 with hair that is parted in a straight line 403 using the parting device of the current invention. FIG. 5*b* shows a top view 425 of a head 426 with hair that is parted at an angle 428 using the parting device. FIG. 5*c* shows a top view 450 a head 451 with hair that is parted in a zig-zag fashion 453 using the parting device. According to the instant invention the ability to create hair styles with complex geometric parts or with high definition parts is enhanced by the use of a stencil described in detail below.

Figure 6A:
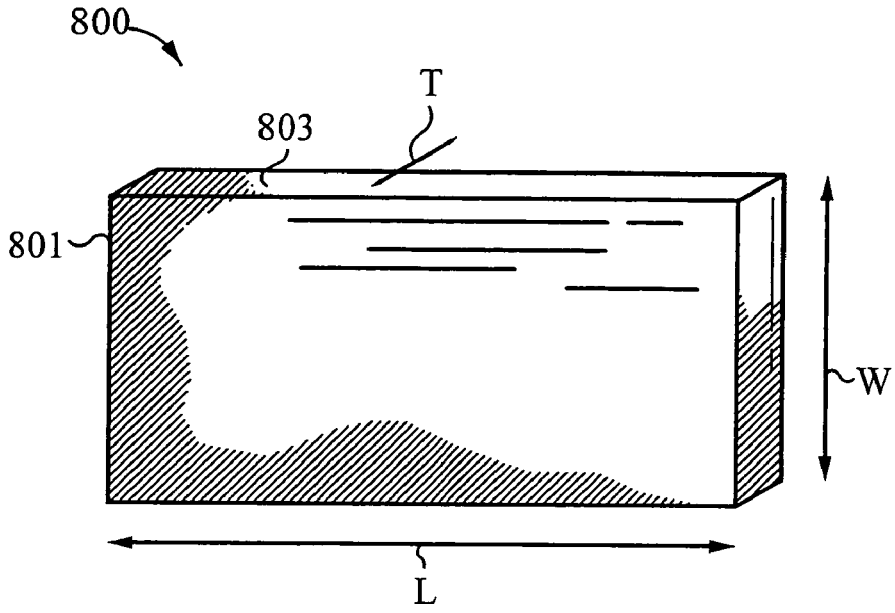
FIG. 6*a-d* illustrate the dimensions of a styling stencil and contoured styling edges of stencils in accordance with the current invention.

FIG. 6*a* illustrates the gross dimensions of a stencil device 800 in accordance with the instant invention. The body 801 of the stencil device is preferably flattened and elongated. The dimensions of the stencil body 801 can vary throughout the stencil device but preferably the average length L is between 5 and 30 cm, the average width W is between of 2 to 10 cm and the average thickness T is between 0.1 and 1 cm. The edge 803 of the body 801 is contoured or patterned to facilitate parting of hair. Styling stencils, in accordance with the instant invention, can have any number of shapes and sizes with any number of contoured or patterned edges to facilitate the parting of hair. The styling stencils utilized in the system and the method of the invention are preferably formed from a flexible and resilient material such as plastic, polyurethane or rubber. The styling stencils are is capable of conforming to the curvature of a human head and return to a flattened elongated state after use. Alternatively, styling stencils are formed from resilient or a rigid materials and exhibit natural or permanent curvature that allows the user to place the stencil on or over hair to be styled.

Figure 6B:
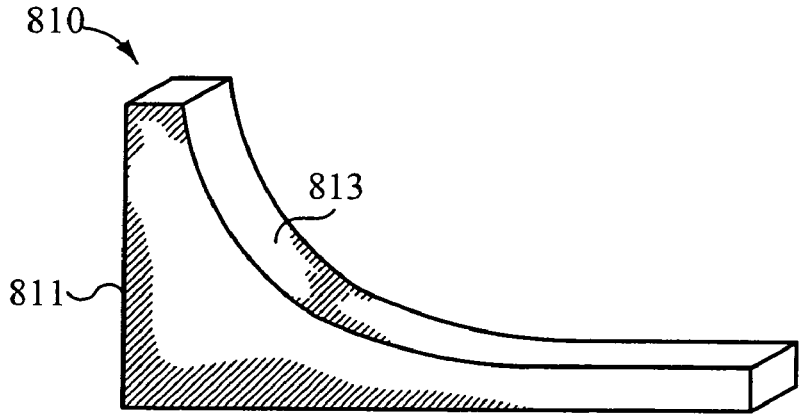
Figure 6C:
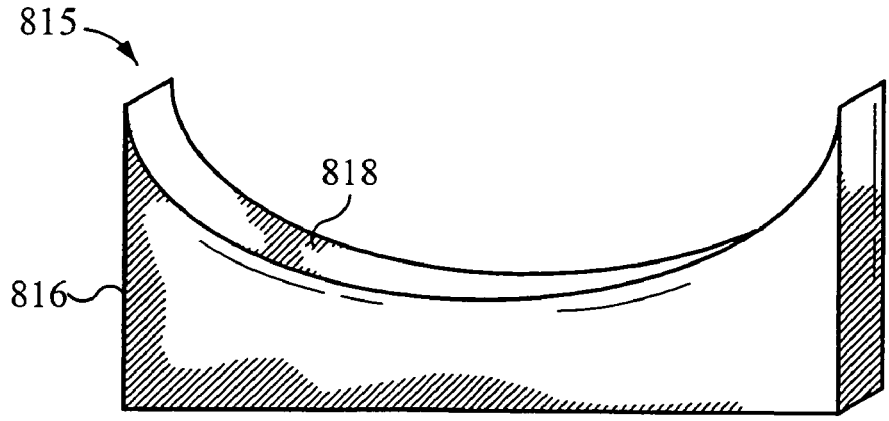
Figure 6D:
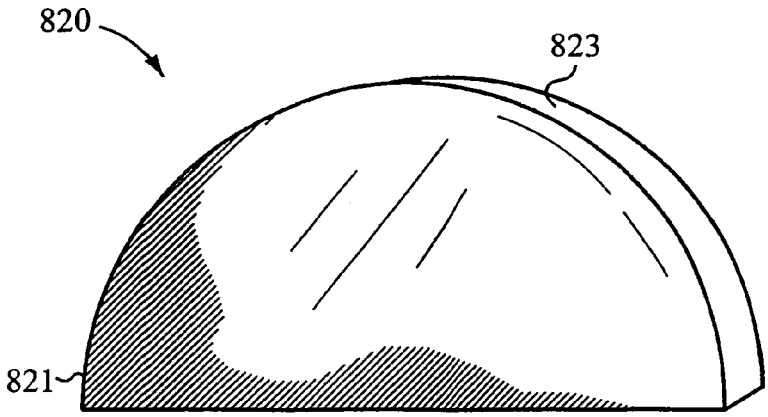

FIG. 6*b* illustrates a stencil device 810 with a stencil body 811 and a sloping styling edge 813. The sloping styling edge 813 of the stencil 810 is used in the system and method of the instant invention to create hair styles with hair that have slope-shaped parts. FIG. 6*c*illustrates a stencil device 815 with a stencil body 816 and a concave styling edge 818. The stencil device 815 is used in the system and method of the instant invention to create hair styles with curved parts. Alternatively, as shown in the FIG. 6*d*, the stencil device 820 has a stencil body 821 and a convex styling edge 823 that is used to create hair styles with curved parts.

Styling edges of the stencils used in the instant invention are patterned or contoured with any number of geometric shapes. For example, FIG. 7*d* illustrates a stencil device 840 with a stencil body 841 and a styling edge 846 that is patterned with and an elongated rectangle 842, a pointed tooth 843, a square tooth 844 and a curved tooth 845 protrusion. Preferably, the styling edges of the stencils are patterned with a plurality of repeating geometric shapes such as rounded scallops, squared teeth or pointed teeth, as shown in FIGS. 7*a*-7*c*.

Figure 7A:
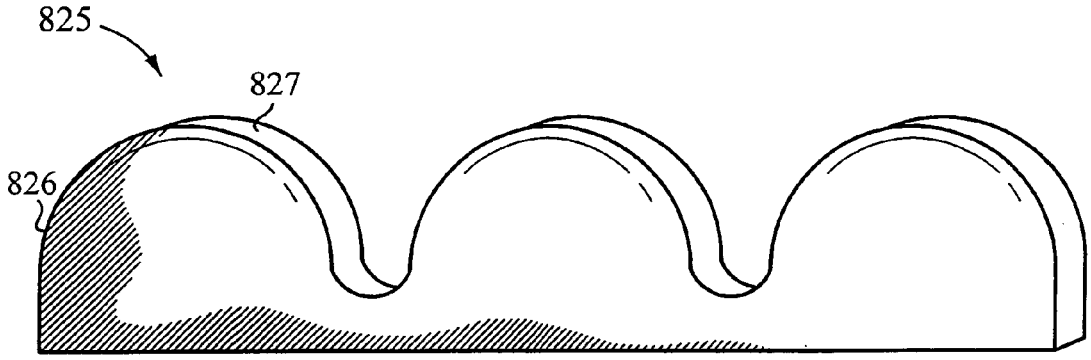
FIG. 7*a-d* illustrate stencils with patterned styling edges in accordance with the current invention.
Figure 7B:
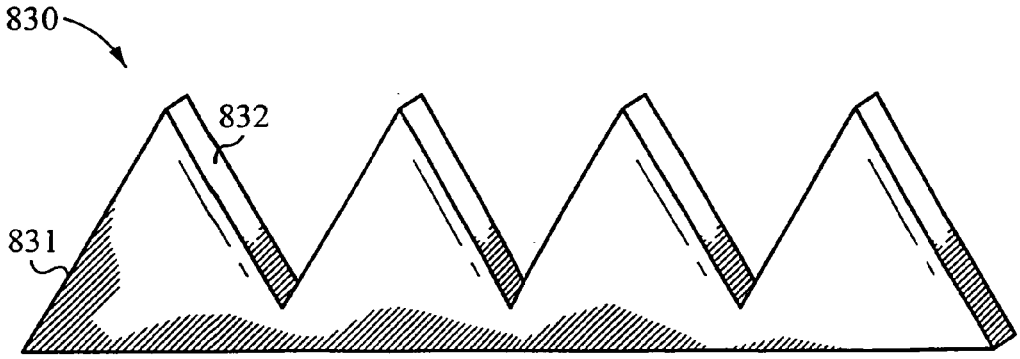
Figure 7C:
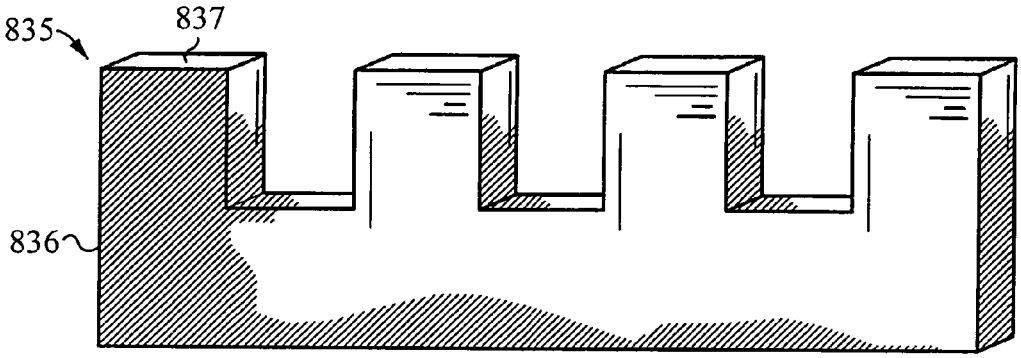
Figure 7D:
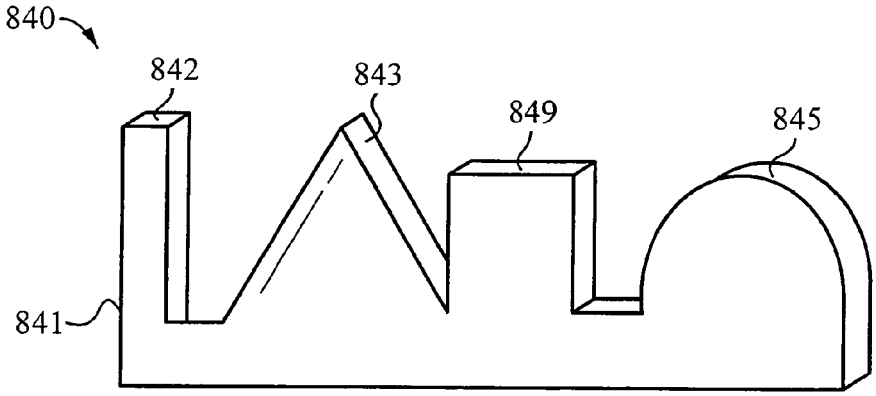

FIG. 7*a* shows a stencil device 825 with a stencil body 826 and a styling edge 827 that is patterned with a plurality of rounded scallops. FIG. 7*b* shows a stencil device 830 with a stencil body 831 and styling edge 832 patterned with a plurality of pointed teeth. FIG. 7*c* shows a stencil device 835 with a stencil body 836 and a styling edge 837 patterned with squared teeth. It will be clear to one of average skill in the art that a stencil device in accordance with the instant invention can have any number of shapes and sizes and have any number of patterned edges.

Figure 8:
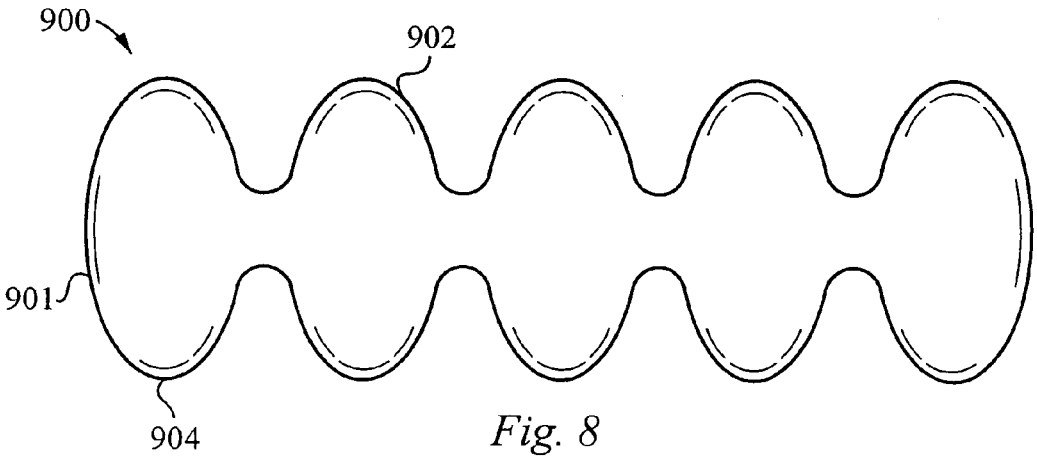
FIG. 8 illustrates a stencil with multiple patterned styling edges in accordance with the current invention.

In an alterative embodiment of the invention the stencil device is patterned on more than one edge. FIG. 8 illustrates a stencil device 900 in accordance with the instant invention. The stencil device 900 has a stencil body 901 with patterned edges 902 and 904. Both of the edges 902 and 904 are shown here with a similar patterns. However, the edges 903 and 904 can be contoured or pattern with different shapes and frequencies of protrusions. Further, stencil devices form a frame such that the patterned edge or edge of the stencil is an interior edge.

Figure 9:
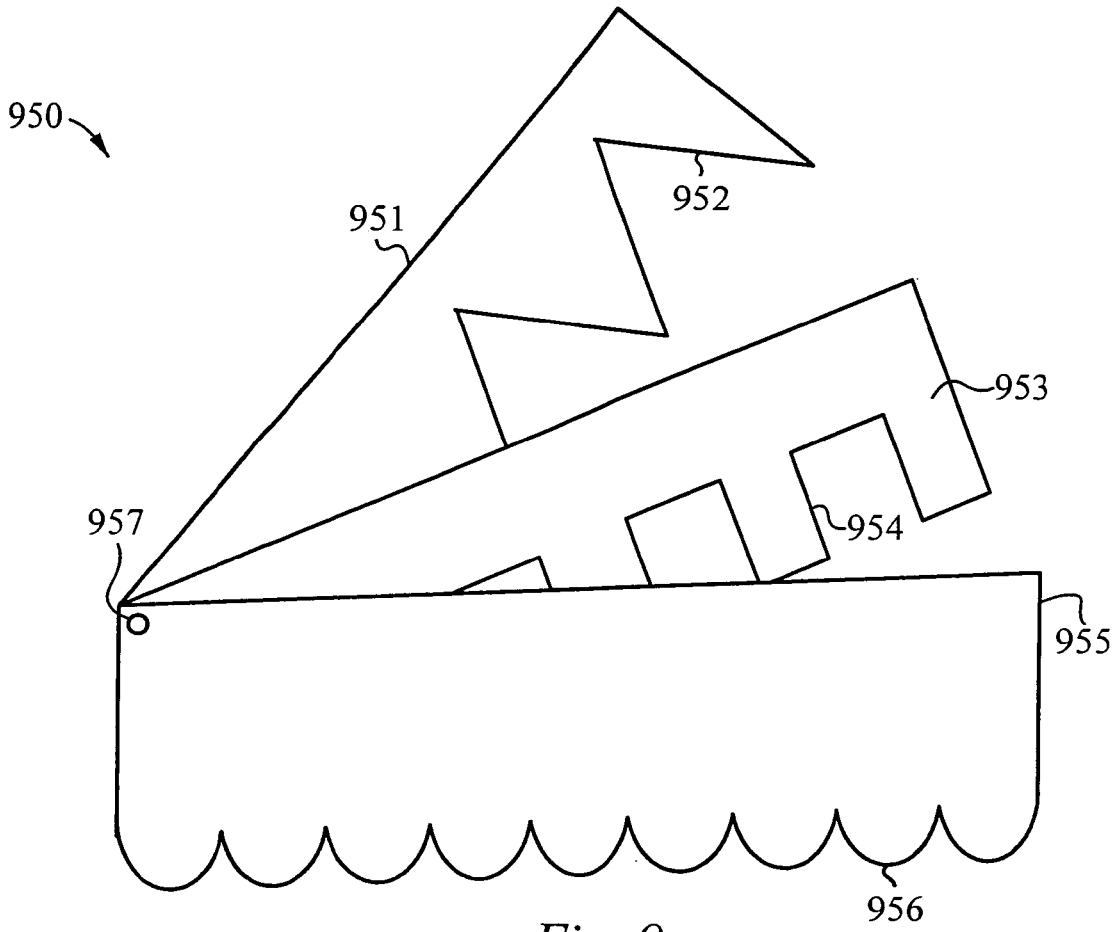
FIG. 9 shows a set of stencils with patterned styling edges.

FIG. 9 shows a set 950 of stencils 951, 953 and 955 that are attached by a hinge element 957 or any other suitable means. They stencils 951, 953 and 955 are permanently attached through the hinge element 957 or alternatively are removably attached through the hinge element 957. Preferably, the stencils 951, 953 and 955 are rotatable about each other so that each stencil is capable of being used individually in a styling operation. The stencil 951 has a pointed tooth patterned styling edge 952, the stencil 953 has a square tooth patterned styling edge 954 and the stencil 955 has a rounded scallop patterned styling edge 956, similar to those described previously. Again, it will be clear from the previous discussion that a stencil, in a set of stencils, such as shown in FIG. 9, can have any number of shapes and sizes and that one or more edges may be patterned or contoured to facilitate the parting of hair.

Figure 10A:
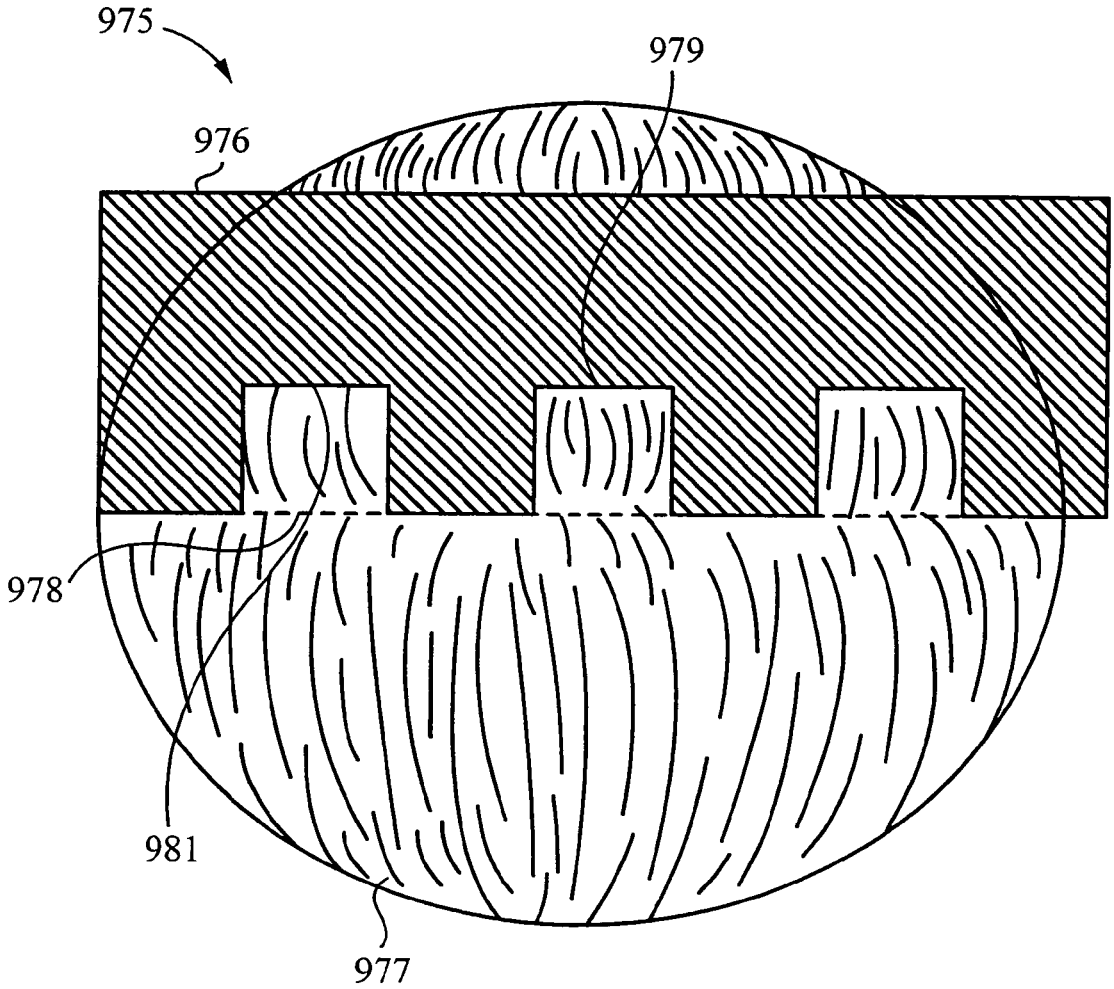
FIG. 10*a-b* illustrate the placement of a stencil with a styling edge on an area of hair and a resultant geometric part formed in accordance with the method of the instant invention.

FIG. 10*a* illustrates a top perspective view 957 of a stencil device 976 placed in a styling position on top of a head of hair 977. The stencil device 976 is shown in FIG. 10*a* as being placed in a styling position with the styling edge 981 of the stencil device 976 near to and parallel with the natural part 978 of the hair 977. However, the method described below is used to part any portion of the hair 977. Further, the method of the instant invention can be used to part hair in any orientation including orientations that are not parallel with the natural part 978 of the hair 977.

Still referring to FIG. 10*a*, the part is created by tracing the styling edge 981 of the stencil device 976 with a tip portion of a parting device (not shown). The tip portion of the parting device is pointed in a forward tracing direction as it is moved through the hair 977 along the patterned edge 981 of the stencil device 976. The hair 977 can be partied by tracing any direction along the patterned edge 981 of the stencil 976 such as front-to-back or back-to-front as long as the tip portion of the parting device is pointed in a forward tracing direction whereby the tip portion is traced through the hair.

Figure 10B:
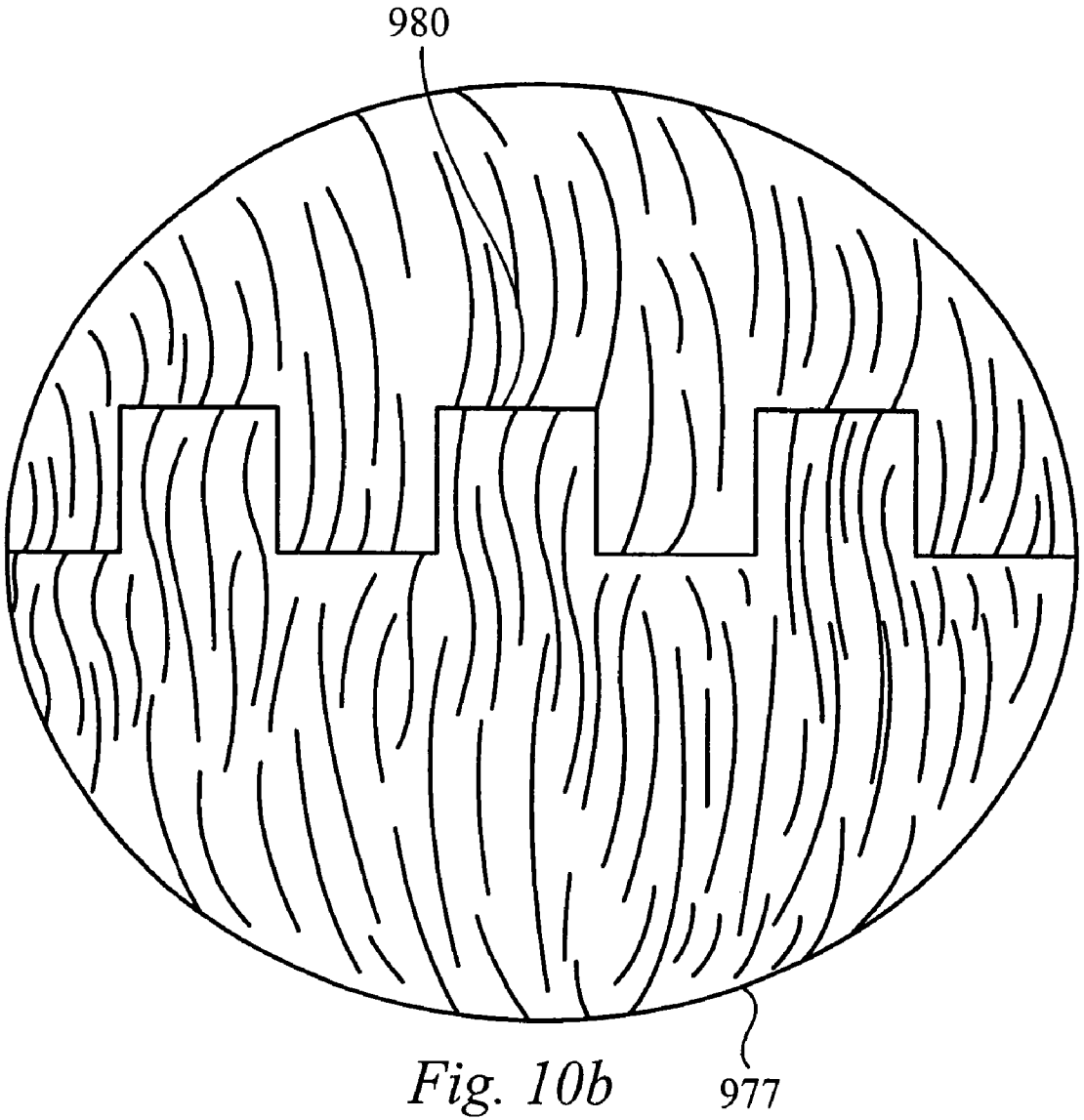

Now referring to FIG. 10*b*, after the pattern of the stencil is traced through the hair 977 with the parting device, then the hair 977 is separated along the trace to create a hair style with a part 980. The part 980 of the hair 977 has a pattern that is substantially similar to the patterned edge 981 of the stencil device 976 shown in the FIG. 10*a*. Penetrably, the pattern of the styling edge 981 is traced out thought the hair 977 near the scalp of the user to obtain a high resolution part 980.

Figure 11:
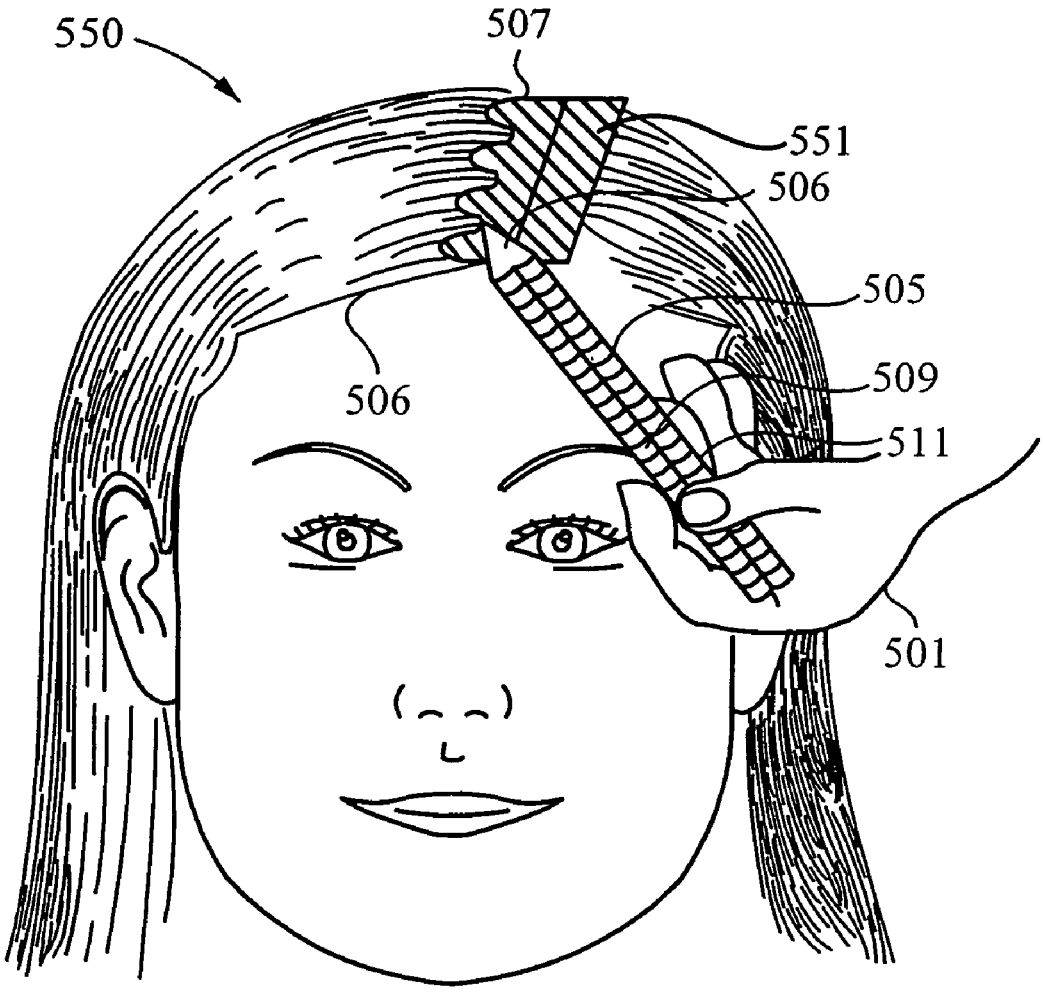
FIG. 11 shows a hair style being created utilizing the system and method of the instant invention.

FIG. 11 illustrates a perspective view of a persons hair 550 being parted with a with a stencil device 551 and a parting device 505 according to the method of the instant invention. The stencil 551 is place on an area of the hair 550 where the part is desired. The parting device 505 is held in the closed position 501 and the tip section 506 is placed in the hair, near to the scalp and pointing in a forward direction. The parting device is moved through the hair 550 along the styling edge 507 of the stencil 551 tracing the pattern of the styling edge 507. As the tip section 507 of the parting device 505 threads through the hair 550 along the styling edge 507 of the stencil 551. The hair 550 will flow over the handles 509/511 of the device 505 and collect thereon. Once the trace of the part is complete, the parting device 505 is paced in the open position, thereby separating the hair 550 to create a part in the hair 550 with a pattern substantially similar to the patterned edge 507 of the stencil 551.

The parting device is not required to open and close, as described above, in order to practice the invention. Alternatively, a non-hinging parting device is used. Accordingly, once the pattern is traced through the hair then lifting the parting device through the hair separates the hair. The step of separating the hair is, however, facilitated if the parting device has a tapered body portion, such shown in the FIG. 2*a* and the step of separating the hair is further facilitated if the parting device has handles which open and close as described above.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Therefore it is understood that the present invention could be implemented in several different ways and have several different appearances.

What is claimed is:

1. A method of parting hair in a preferred configuration comprising:

a. placing a template with a patterned edge on a section of hair;

b. placing a pointed tip portion of a styling device near the patterned edge of the template, the styling device comprising a first and a second handle coupled by one end of each of the first and second handles to the pointed tip portion through a first and a second hinge element;

c. tracing along the patterned edge of the template with the handles aligned in a closed position and the pointed tip portion pointing in a forward tracing direction; and d. separating the handles to an open position about the pointed tip portion, thereby parting the hair in the preferred pattern.

2. A method of making a hair parting system comprising;

a. forming a flexible elongated stencil with a plurality of geometric protrusions along a styling edge; and b. forming a separate parting device comprising an extended tip section with a pointed end, wherein the parting device is configured to trace a pattern through hair and along the styling edge of the stencil, while the styling stencil is held against the hair and wherein forming a separate parting device comprises:

a. forming a first elongated handle;

b. forming a second elongated handle; and c. attaching the first and the second elongated handles opposite the pointed end of the extended tip section through hinge elements, such that unattached ends of the handles are capable of being aligned in a closed position and separated in an open position in a jaw-like fashion through the hinge elements.

* * * * *

UNITED STATES PATENT AND TRADEMARK OFFICE

CERTIFICATE OF CORRECTION

PATENT NO. : 7,478,639 B2
APPLICATION NO. : 09/742871
DATED : January 20, 2009
INVENTOR(S) : Barbara Stachowski It is certified that error appears in the above-identified patent and that said Letters Patent is hereby corrected as shown below:

IN THE SPECIFICATION

At column 3, line 4, please replace "reduce d" with "reduced" so that the corresponding sentence reads
-- For example, by having reduced thicknesses of the resilient material at the hinging points, the handles will bend through these points when a deforming force is applied to the handles. --

At column 5, line 5, please delete the word "to" and replace the word "grove" with "groove" so that the corresponding sentence reads
-- Alternatively, the grooming element 109 may be slidably positioned into a groove on the side of the handle 107 such that sliding the grooming element 109 in one direction or the other direction along the length of the handle 111', as indicated by the arrow 123, allows the element to be released from the handle 111'. --

At column 5, line 37, please delete the word "t" so that the corresponding sentence reads
-- Accordingly, the hinge elements 203 and 205 are thin pieces of the resilient pliable material connecting the thicker tip section 201 and the handles 209/211 such that the hinge elements 203 and 205 flex or bend when handles 209 and 211 are pulled apart or drawn together. --

At column 7, line 7, please delete the word "and", and at line 8 please replace "844" with "849" so that the corresponding sentence reads
-- For example, FIG. 7*d* illustrates a stencil device 840 with a stencil body 841 and a styling edge 846 that is patterned with an elongated rectangle 842, a pointed tooth 843, a square tooth 849 and a curved tooth 845 protrusion. --

Signed and Sealed this

Thirty-first Day of March, 2009

JOHN DOLL
*Acting Director of the United States Patent and Trademark Office*